United States Patent [19]

Kiehl et al.

[11] Patent Number: 4,482,258

[45] Date of Patent: Nov. 13, 1984

[54] PARKING METER WITH LIMITED VISIBILITY POINTER

[75] Inventors: William C. Kiehl, Russellville; James P. McEwen, Plainview, both of Ark.

[73] Assignee: Deta Corporation, Russellville, Ark.

[21] Appl. No.: 490,480

[22] Filed: May 2, 1983

[51] Int. Cl.[3] ..... G04F 3/00

[52] U.S. Cl. ..... 368/90; 194/DIG. 22

[58] Field of Search ..... 368/90–92; 194/1 F, 9 T, DIG. 21, DIG. 22

[56] References Cited

U.S. PATENT DOCUMENTS 3,026,983 3/1962 Hamilton ..... 194/DIG. 22

3,913,718 10/1975 Zajac ..... 194/72

*Primary Examiner*—Vit W. Miska

*Attorney, Agent, or Firm*—Hill, Van Santen, Steadman & Simpson

[57] ABSTRACT

A coin operated parking meter which includes a meter housing having a coin receiving slot and spaced transparent closure windows. A time dial is provided with time indicia thereon and the dial is mounted in the housing between the windows. A translucent time indicating pointer is pivotally movable from one end through an arc relative to the time dial in the housing. The translucent pointer is visible on a short range basis to the naked human eye when a motorist is positioned near the meter for advising time available for parking and with the translucent time indicating pointer being relatively invisible to the naked human eye when viewed by a person on a longer range basis such as from an adjacent street by a cruising motorist. A swingable violation flag is swingably mounted to arcuate movement when the translucent time indicating pointer falls to a zero time position.

7 Claims, 3 Drawing Figures

PARKING METER WITH LIMITED VISIBILITY POINTER

THE FIELD OF THE INVENTION

The present invention relates generally to coin operated parking meters and has particular reference to various types of meters that are usable for individual parking spaces and where the meters are mounted with one meter in each of a series of parking spaces located in long roadways or in parking lots.

THE PRIOR ART

Martin U.S. Pat. No. 2,629,438 uses transparent dial faces to carry a coin. Iapadre U.S. Pat. No. 2,927,675 conceals the remaining time with a shutter. Sollenberger 3,027,866 uses two flags, a valid flag and a violation flag and omits a time indicator. Lazarow U.S. Pat. No. 3,636,701 uses a mask with spaced slots to limit visibility of a pointer that moves over a time dial. May et al U.S. Pat. No. 3,964,590 conceals the time remaining by requiring the operating handle to be turned to reveal the time on the clock.

SUMMARY OF THE INVENTION

Coin operated parking meters generally include a meter housing having a coin receiving slot and spaced transparent closure windows on opposite sides of the housing. A time dial with time indicia thereon is mounted in the housing between the windows. In accordance with this invention, a translucent time indicating pointer is pivotally movable from one end through an arc relative to the time dial in the housing and is specifically constructed and arranged to be of limited visibility, i.e. visible on a short range basis to the naked human eye when positioned near the meter for advising time available for parking when viewed relative to the time dial, but with the translucent time indicating pointer being relatively invisible to the naked human eye when viewed on a longer range basis from an adjacent street by a cruising driver.

As stated another way, my invention concerns parking meters which are traffic-controlled devices to aid in parking turnover. Most regulations and specifications related to meters require that the meters indicate the time remaining on the meter. The pointer on current models of meters are visible from the street which causes a problem called "cruising". Motorists slowly driving (cruising) to look for a meter with time remaining (some look for the meter with the most time) add to traffic congestion.

The limited visibility pointer is constructed to reduce the cruising problem. Since it cannot be ready seen, the motorist cannot determine the time remaining; however, it is visible at close range, thus meeting the criterion of indicating time remaining.

An important object of my invention is to provide a new and improved parking meter having a limited visibility pointer to inhibit motorists from driving slowly or cruising to look for a meter with time remaining or with the most time available so as to cause traffic congestion in the area where the parking meters are installed.

According to other features of my invention, I have provided a coin operated parking meter which includes a meter housing of a type having a coin receiving slot and spaced transparent closure windows, a time dial with time indicia thereon mounted in the housing between the windows, a translucent time indicating pointer is pivotally movable from one end through an arc relative to the time dial in the housing and is visible on a short range basis to the naked human eye when a motorist is positioned near the meter for advising time available for parking and with the translucent time indicating pointer being relatively invisible to the naked human eye when viewed by a person on a longer range basis such as from an adjacent street by a cruising motorist, and a swingable violation flag swingably mounted to arcuate movement when the translucent time indicating pointer falls to a zero time position.

DESCRIPTION OF THE DRAWINGS

In the accompanying sheet of drawings which forms a part of this specification, a single embodiment of the invention is illustrated as follows.

DESCRIPTION OF THE PREFERRED EMBODIMENTS

Figure 1:
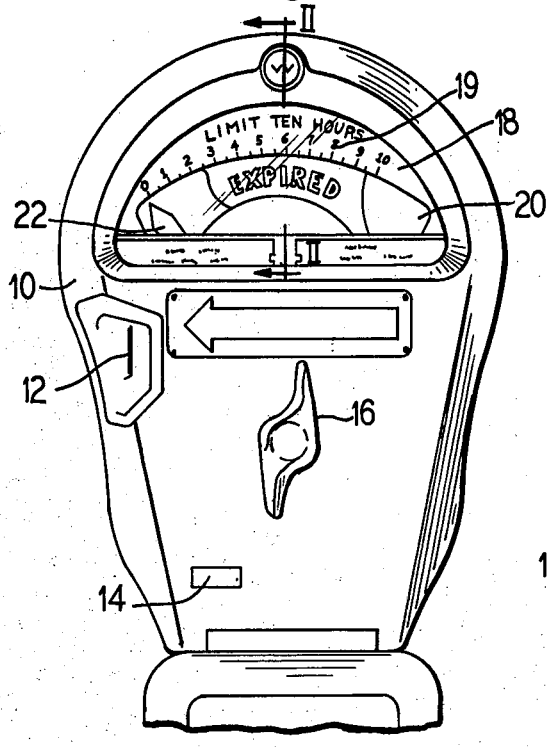
FIG. 1 is a fragmentary front elevation of a coin operated parking meter in accordance with this invention.
Figure 2:
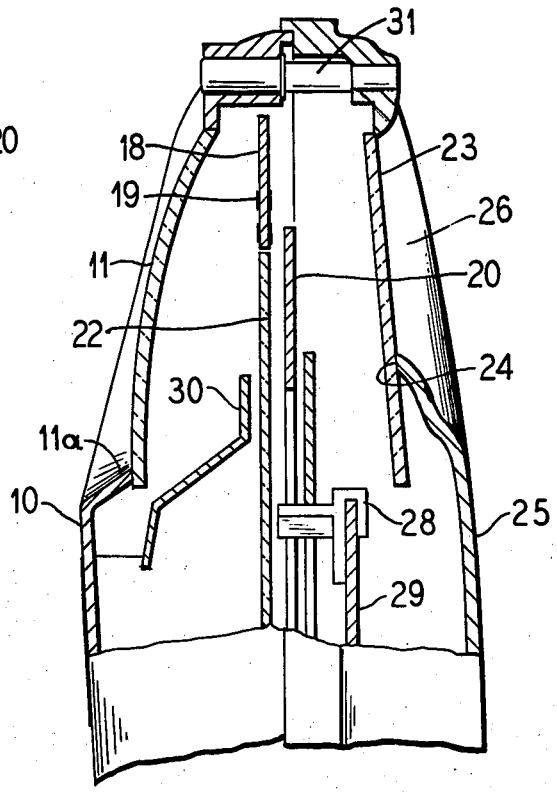
FIG. 2 is an enlarged fragmentary vertical section taken on the line II—II looking in the direction indicated by the arrows as seen in FIG. 1.
Figure 3:
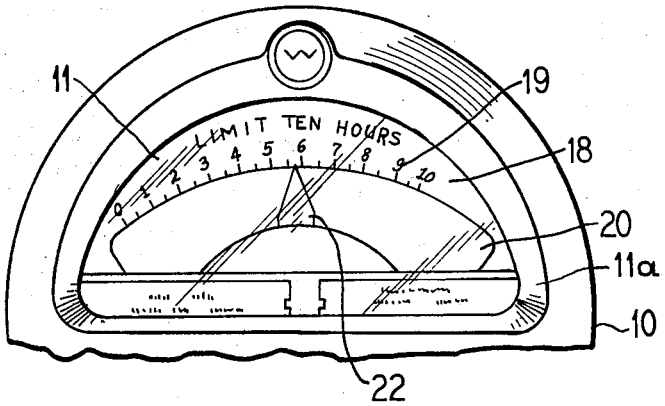
FIG. 3 is an enlarged fragmentary front elevation similar to FIG. 1 only illustrating the translucent or limited visibility pointer in a position showing time left on the meter for "paid up" parking.

Referring now to the drawings in detail and in particular to FIGS. 1, 2 and 3, a parking meter 8 is illustrated which is generally of a construction which is commercially available but which embodies the principles of the present invention. Various mechanical devices and drive means for permitting the parking meter to function in its normal manner are well known in the art. A typical parking meter construction is shown in any number of different patents, but for purposes of general reference attention is directed to U.S. Pat. No. 3,964,590.

The parking meter 8 more specifically includes an external housing 10 having a transparent window 11 set in a bevelled opening 11A. A coin slot for receiving coins is shown at 12 and a coin return slot is shown at 14. A twist knob or operating handle 16 is operated after insertion of coins to actuate the usual mechanism and to present the purchased amount of time on a time calibrated dial 18. The time dial 18 contains time limits indicia 19 provided for the meter. An expiration or violation flag 20 is caused to rise to signal that the rental period paid for has expired.

In accordance with the invention a presettable movable indicia means comprises a limited visibility or translucent pointer 22 and points to the time scale to indicate the amount of paid for time remaining. It will be understood that the movable indicia means moves as a function of time, i.e. it is operatively connected to a clock mechanism which drives it as a function of time after it has been preset following insertion of the requisite coin or coins.

The present invention contemplates that the pointer 22 be constructed such that it has a limited visibility, that is so that it will be visible to a person standing close to the meter, such as a person depositing coins, however will be relatively invisible to a person some distance from the meter, such as a motorist driving by or "cruising" looking for an open parking spot. The limited visibility pointer 22 will satisfy the regulations and specifications that require that the meters indicate the time remaining on the meter. However, the limited visibility pointer 22 will prevent motorists from slowly driving past available parking stalls looking for a meter with a significant amount of time remaining.

It is further contemplated that the limited visibility pointer 22 for parking meters may take other forms. For example, the clear or transparent pointer could be outlined or have a thin opacified line up the middle for registration with the time increments on the dial 18. There could be variations in the length or it might be made translucent to blend with the meter case color or background. The pointer 22 can be made from any suitable material such as a clear transparent synthetic plastic and the like.

It is contemplated that my limited visibility pointer 22 can be installed upon many of the existing parking meters and also on new parking meters merely by removing the oil pointer and making a new one having the same configuration only being made from a translucent material so that the pointer can function in accordance with my invention as a limited visibility pointer. It will further be appreciated that my translucent time indicating pointer is pivotally movable from its lower end where connected to the actuating timer mechanisms for causing the time indicating pointer 22 to move through an arc relative to the time dial in the housing so that it is visible on a short range basis to the naked human eye when positioned near the meter for advising time available for parking when viewed relative to the time dial. The limited visibility pointer or translucent time indicating pointer 22 is invisible to the naked human eye when viewed on a longer range basis such as from an adjacent street by a cruising driver.

The swingable violation flag 20 is swingably mounted for arcuate movement when the translucent time indicating pointer 22 falls to a zero time position as viewed in FIG. 1, but which flag 20 is invisible when the pointer is indicating that time is still available on the meter as viewed in FIG. 3.

A rear transparent window 23 covers a corresponding opening 24 bevelled as at 26 and formed in a rear casting 25 referring to FIG. 2, a violation flag 27 is shown positioned for engagement with a flag bumper 28 which, in turn, is mounted on a back plate assembly 29. A so-called T & I plate is provided at 30. The front and rear parts of the casing are held together by appropriate fastening means 31.

Although various modifications might be suggested by those versed in the art, it should be understood that I wish to embody within the scope of the patent warranted hereon all such modifications as reasonably and properly come within the scope of my contribution to the art.

I claim:

1. In a coin operated parking meter including a meter housing having a coin receiving slot and spaced transparent closure windows, a time dial with time indicia thereon mounted in the housing between the windows, the improvement of a translucent time indicating pointer pivotally movable from one end through an arc relative to the time dial in the housing and visible on a short range basis to the naked human eye when a motorist is positioned near the meter for advising time available for parking and with the translucent time indicating pointer being relatively invisible to the naked human eye when viewed by a person on a longer range basis such as from an adjacent street by a cruising motorist, and a swingable violation flag swingably mounted to arcuate movement when the translucent time indicating pointer falls to a zero time position.

2. The meter of claim 1 further characterized by the pointer having a thin line up the middle for registration with the time increment on the dial.

3. The meter of claim 1 further characterized by the pointer being outlined by a thin line.

4. For use in a coin operated parking meter, a time calibrated dial normally visible through a transparent window, movable indicia means positioned to selectively scan said dial as a function of time, said movable indicia means more particularly comprising a translucent member which is virtually invisible except when viewed at close range.

5. In combination with a parking meter of the type having a time calibrated indicating scale thereon, the improvement of a limited visibility pointer means relatively movable in close adjacency to said scale as a function of time and presenting a measure of elapsed and remaining time to the observer, said pointer being translucent so as to reduce the visibility thereof as a dial function of the distance of the observer from the meter.

6. In the combination of claim 5 wherein the pointer means constitutes a transparent clear marker having a thin opacified line thereon for registration with the time calibrated indicating scale.

7. In a parking meter having a presettable coin actuated clock means giving a visible indicating of remaining time by means of a movable indicia marker, the improvement of a low visibility marker made of clear transparent material which is readily visible relative to an adjoining time increment scale only at close range.

* * * * *